United States Patent [19]

Antos et al.

[11] Patent Number: 4,570,273

[45] Date of Patent: Feb. 18, 1986

[54] PORTABLE TOILET POURSPOUT

[75] Inventors: John M. Antos, Ann Arbor; John Selina, Ypsilanti, both of Mich.

[73] Assignee: Thetford Corporation, Ann Arbor, Mich.

[21] Appl. No.: 566,650

[22] Filed: Dec. 29, 1983

[51] Int. Cl.[4] ..... E03D 1/00

[52] U.S. Cl. ..... 4/321; 4/323; 4/661; 220/85 SP; 222/566; 222/567; 222/568

[58] Field of Search ..... 4/321-323, 4/449, 661, 455, 471; 222/567, 566, 533, 570, 478, 568; 285/DIG. 15, 360, 401, 376; 220/85 SP, 296; 137/269, 315, 587

[56] References Cited

U.S. PATENT DOCUMENTS

| | | | |
|---|---|---|---|
| 1,557,451 | 10/1925 | Gibson | 222/568 X |
| 1,761,477 | 6/1930 | Kahle | 222/568 X |
| 1,931,032 | 10/1933 | Panfil | 222/568 X |
| 2,105,718 | 1/1938 | Chamberlain | 222/568 X |
| 2,294,637 | 9/1942 | Thomsen | 222/568 |
| 3,058,633 | 10/1962 | Mühlhoff | 222/568 |
| 3,206,083 | 9/1965 | Nishina | 222/568 X |
| 3,430,824 | 3/1969 | Conners et al. | 222/568 X |
| 4,129,236 | 12/1978 | Wrycraft et al. | 222/568 X |
| 4,215,445 | 8/1980 | Antos et al. | 4/323 |

FOREIGN PATENT DOCUMENTS

| | | | |
|---|---|---|---|
| 0095903 | 12/1983 | European Pat. Off. | 4/460 |
| 1187435 | 2/1965 | Fed. Rep. of Germany | 285/DIG. 5 |

*Primary Examiner*—Henry K. Artis

*Attorney, Agent, or Firm*—Stephenson and Boller

[57] ABSTRACT

A pourspout accessory kit for use with a portable toilet holding tank to facilitate dumping of the holding tank's contents via an outlet opening in the holding tank. The accessory kit copmrises a pourspout having an inlet end for attachment to the holding tank outlet opening and an outlet end spaced from the inlet end. Respective inlet and outlet end closure caps cover the inlet and outlet ends respectively of the pourspout. The inlet end of the pourspout is configured to fit a holding tank outlet opening having either a partial internal screw thread or a full external screw thread. The attachment to the partial internal screw thread is by means of a pair of bayonets on diametrically opposite sides of the pourspout which engage the partial screw threads on diametrically opposite sides of the holding tank outlet opening. The attachment of the pourspout to the external screw thread is by means of a retainer element fitted over the pourspout and which has an endwall overlapping a circumferential flange on the pourspout and a sidewall having an internal screw thread which threads onto the external thread of the holding tank outlet opening. An O-ring seal seats in a circumferential groove extending around the outside of the pourspout adjacent the flange and provides a leak-proof seal when the pourspout is attached to the holding tank. Two embodiments of O-ring seal are disclosed. The provision of closure caps for both ends of the pourspout provides for its convenient stowage when not in use. The accessory kit can be used with newly purchased toilets as well as those already owned by users.

12 Claims, 13 Drawing Figures

PORTABLE TOILET POURSPOUT

REFERENCE TO A RELATED APPLICATION

Reference is made to pending U.S. patent application Ser. No. 383,410, filed June 1, 1982, commonly assigned and relating to the same general subject matter.

BACKGROUND AND SUMMARY OF THE INVENTION

This invention relates to portable toilets and more specifically to a spout for association with the holding tank of such a portable toilet for the purpose of emptying the contents of the holding tank.

Portable toilets have come to enjoy widespread popularity, particularly in the recreational field. The assignee of the present patent application, Thetford Corporation, has been the leading innovator in portable toilets. One such innovation is the two-piece portable toilet which has separably mounted seat and holding tank sections. The seat section comprises a bowl having a bottom discharge outlet in sealed relation with an opening in the holding tank section. A flush water storage reservoir surrounds the bowl and a flush medium, such as flush water, may be introduced into the bowl from the storage reservoir by means of a hand operated pump. The contents of the bowl are deposited into the holding tank section by operation of a valve at the holding tank opening. The holding tank serves to accumulate waste contents from the bowl as the toilet is used.

From time to time the holding tank is emptied. This is done by removing the seat section from the holding tank section, transporting the holding tank section to a suitable disposal facility, removing an outlet cap from an outlet opening on the holding tank and pouring out the contents of the holding tank through its outlet opening and into the disposal facility. One or more rinsing operations may thereafter be conducted on the holding tank section to more thoroughly remove any minute amounts of residual waste material. The outlet cap is then put back in place, and the seat section finally remounted on the holding tank section.

As explained in the aforementioned pending U.S. patent application Ser. No. 383,410, the inclusion of a separate spout on the holding tank section can be beneficial. One advantage is that the dumping procedure is made more convenient and can be accomplished with less concern for back-splashing of the waste discharge.

Insofar as applicants are aware, the disclosure of pending application Ser. No. 383,410 is the sole disclosure of a portable toilet with a separate pourout spout for the holding tank section.

Theretofore the usual practice had been to provide a threaded boss circumscribing an outlet opening and a threaded cap threaded onto the boss to close the opening. When the contents were to be dumped, the cap was unscrewed and the waste materials poured out.

The pourout spout disclosed in that patent application is an integral part of a new model of portable toilet also illustrated therein. That spout and toilet were designed to incorporate new and unique cooperative features forming certain details of the invention of that application. One such detail comprises a particular keyed connection of the pourout spout with the aperture in the holding tank section within which one end of the pourout spout is disposed.

The present invention is directed to a portable toilet pourspout which can be used with a range of different portable toilet models. This is an important aspect of the invention for it allows a pourspout to be offered to customers as an accessory item for use not only with newly purchased toilets, but also with previously purchased ones as well. By virtue of unique features the pourspout of the present invention is adapted for many existing models of portable toilets so that there is no need to redesign or modify those existing models of portable toilets merely to accept the new pourspout. For customers already owning portable toilets, it means that they do not have to modify their toilets, and for the toilet manufacturer, it means no retooling of existing toilets.

In addition to the foregoing, the pourspout of the present invention is endowed with a stowage capability which minimizes the risk that waste products will accidentally come in contact with the user or with the environment in which the spout is stowed when not in use.

Still another attribute of the invention involves the particular design of the pourspout which renders its attachment compatible with various models of portable toilets yet imposes no significant restriction on the discharge of the waste contents through it. When in use the pourspout promotes an efficient discharge of waste contents while minimizing the risk that waste contents passing through the spout might impede the desired discharge flow through the spout and/or back-splash.

In its preferred embodiment the invention is offered in a kit form containing several component parts. The kit affords the customer the capability for attachment to a range of portable toilet models without the use of tools or the need to make modifications to his toilet. It also provides the stowage capability referred to above.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
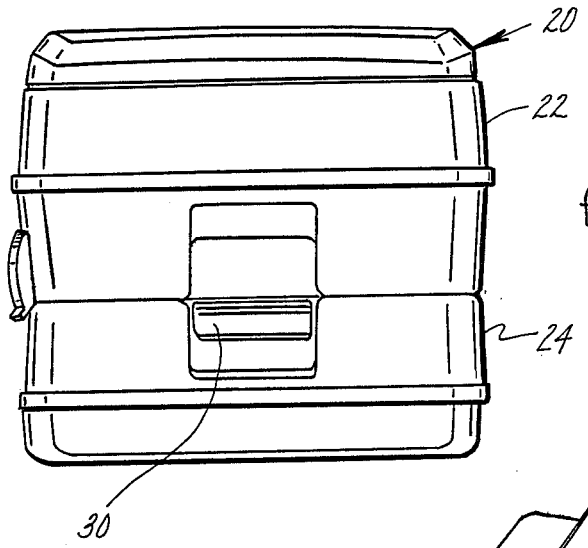
FIG. 1 is a front elevational view of an example of one model of two-piece portable toilet with which the pourspout of the present invention may be used.

FIG. 1 illustrates an example of one model of portable toilet 20 with which the pourspout of the present invention is adapted to be used. The toilet illustrated in FIG. 1 is similar to that shown in U.S. Pat. Nos. 4,215,445 and 4,180,876 both of which are assigned to the same assignee as the present application.

Figure 2:
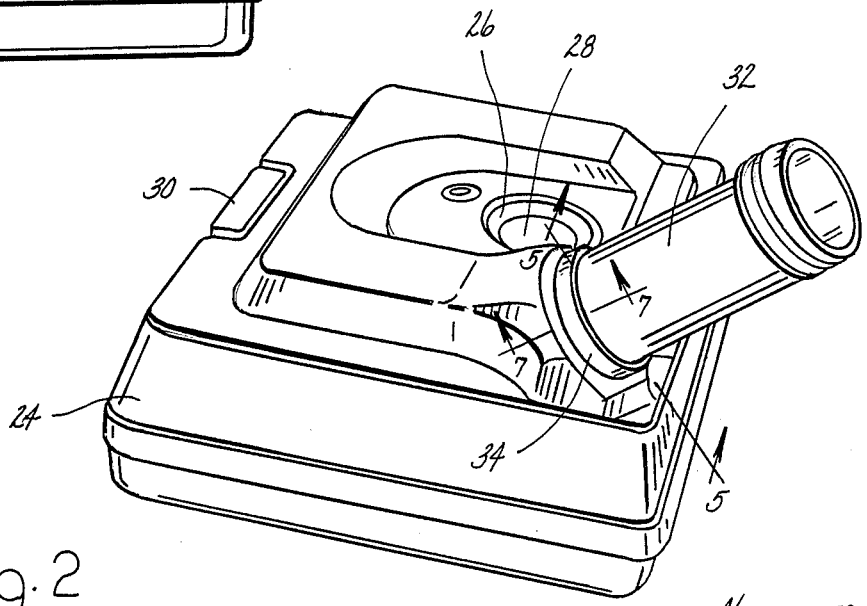
FIG. 2 is a perspective view of the holding tank of the portable toilet of FIG. 1 with the pourspout of the present invention cooperatively associated therewith.

Portable toilet 20 comprises a seat section 22 separably mounted atop a holding tank section 24. Seat section 22 contains a bowl having a bottom discharge outlet which is in communication with an inlet opening 26 (see FIG. 2) of the holding tank 24. Referring now also to FIG. 2, holding tank 24 comprises a flat slide valve 28 which is operable by an external operating handle 30 to open and close inlet opening 26 and thereby permit the accumulated contents of the bowl to be deposited by force of gravity into the holding tank.

FIG. 2 illustrates a pourspout 32 embodying principles of the invention cooperatively associated with holding tank 24. Holding tank 24 has an outlet opening 34 which, prior to the pourspout of the present invention, was closed by a removable cap, such as shown in U.S. Pat. No. 4,215,445. The cap was removed at the time of emptying the holding tank, and the contents were poured through outlet opening 34. With the addition of pourspout 32, emptying the contents of the holding tank is rendered more convenient, and there is less risk of waste back-splashing as it is being poured from the holding tank.

Figure 3:
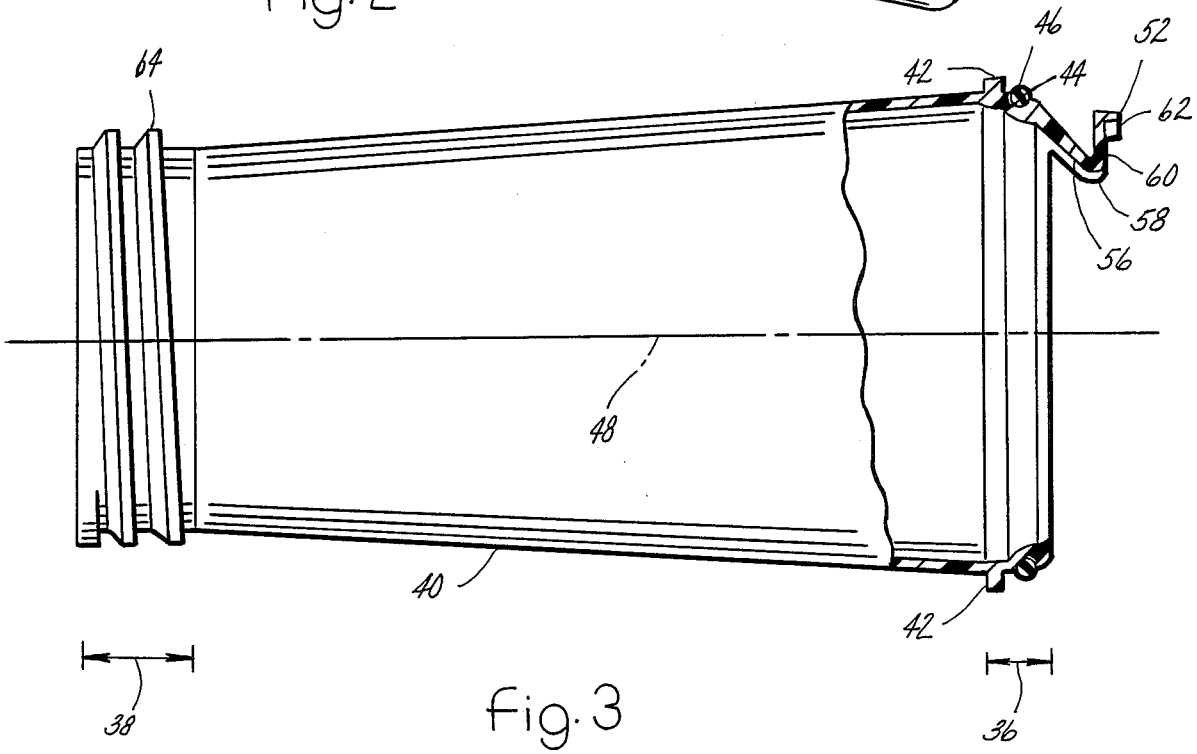
FIG. 3 is a longitudinal view, partly in cross section, of the pourspout of FIG. 2, the cross sectional portion being substantially as taken in the direction of arrows 3—3 in FIG. 4.
Figure 4:
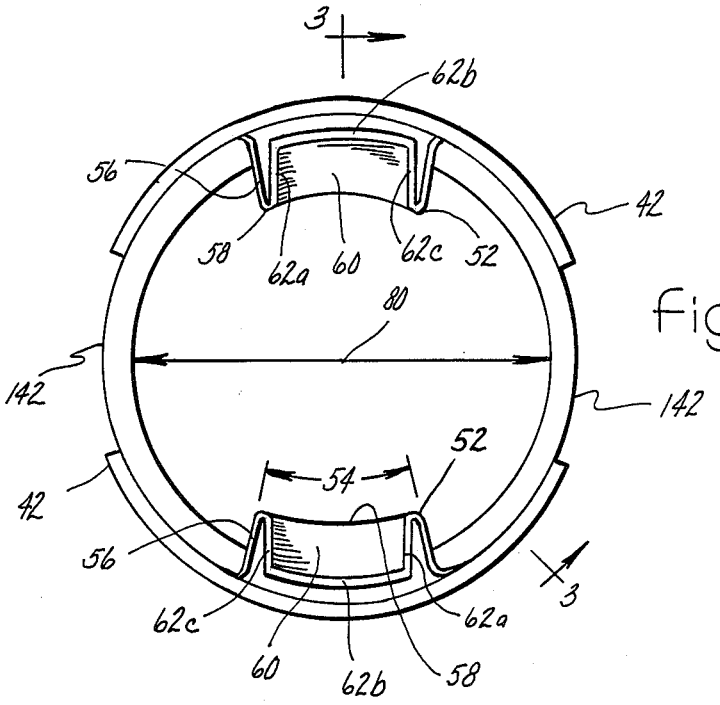
FIG. 4 is a full right hand end view of FIG. 3.

Referring now to both FIGS. 3 and 4 as well, pourspout 32 is seen to be a tubular walled element, plastic is the preferred material, having an inlet end section 36 which attaches to opening 34 and an outlet end section 38 via which the contents of the holding tank are discharged. It may be considered to comprise a main walled section 40 extending between the inlet and outlet end sections 36 and 38 respectively. Section 40 is provided with a slight frustoconical taper such that the pourspout narrows in diameter in the direction running from inlet end to outlet end.

Inlet end section 36 comprises a circular flange 42 which extends around the outside of the pourspout. Closely adjacent flange 42 on the side thereof which is opposite the outlet end, the pourspout is provided with a groove 44 extending continuously around its outside. Groove 44 has an approximately semi-circular cross sectional shape so that an elastomeric O-ring seal 46 of circular cross section can be fitted onto the inlet end of the pourspout and seat in groove 44 as shown in FIG. 3. It will be observed that the radial distance from the longitudinal axis 48 of the pourspout to the radially outermost point of O-ring 46 is slightly less than the radial distance from axis 48 to the radially outermost point of flange 42.

Inlet end section 36 is further provided with a pair of integrally formed bayonets 52 on diametrically opposite sides. As will become more apparent from the ensuing description, these bayonets 52 provide for an interlocking attachment of the pourspout on outlet opening 34 of holding tank 24.

Each bayonet 52 has a limited arcuate extent 54 as shown in FIG. 4. As can be better seen in FIG. 3, each bayonet 52 comprises a first portion 56 which extends radially inwardly and axially away from O-ring 46. This first portion 56 merges into a reverse turn second portion 58 which itself merges into a radially outwardly extending third portion 60. Portion 60 has opposite axial faces, one of which faces in the direction of the first portion 56 and the other of which faces in the opposite direction. On this latter face of each portion 60, each bayonet is provided with an axially extending flange portion 62. The axially extending flange portion 62 may be considered as having three sides bounding three sides of the four sided face of portion 60. These three sides are identified by the reference numerals 62*a*, 62*b*, and 62*c*.

Outlet end section 38 is illustrated to have essentially a constant nominal diameter throughout its axial extent. A screw thread 64 is provided around the outside of outlet end section 38 to provide for the threaded mounting of a closure cap (not shown in FIG. 3).

Figure 5:
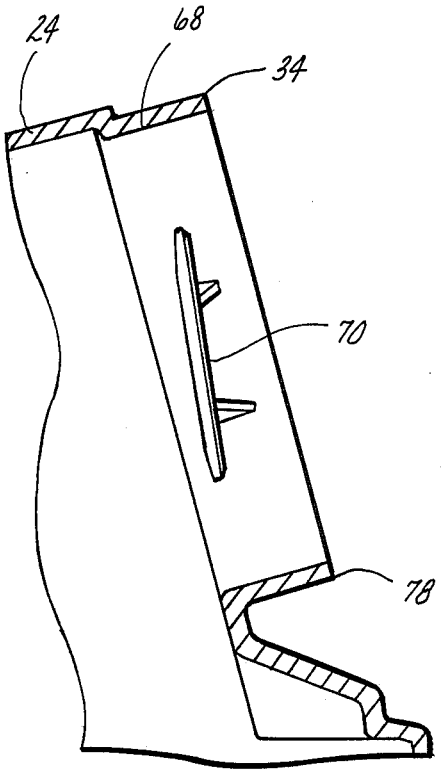
FIG. 5 is an enlarged fragmentary cross sectional view taken generally in the direction of arrows 5—5 in FIG. 2, but without the pourspout.
Figure 6:
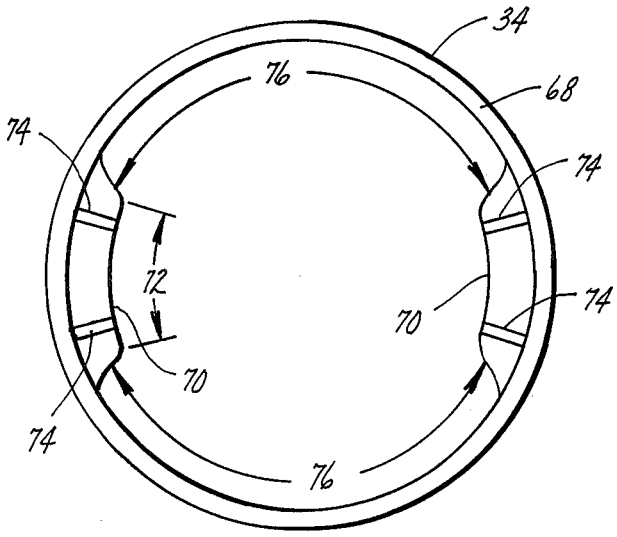
FIG. 6 is a right hand end view of a portion of FIG. 5.

In order to explain how inlet end section 36 of the pourspout is attached to holding tank 24, a further description of the holding tank outlet 34 is presented with reference to FIGS. 5 and 6. Outlet 34 comprises a nominal circular tubular wall 68. Partial screw threads 70 are provided on the I.D. of wall 68 on diametrically opposite sides. As can be seen in FIG. 6 these partial screw threads have limited arcuate extents 72. Each screw thread 70 is integrally formed with wall 68 of outlet 34 and triangular reinforcements 74 are also integrally formed as shown to strengthen the construction. As can also be seen in FIG. 6 the opening bounded by wall 68 has arcuate spaces 76 between the arcuate spans 72 of the partial screw threads 70.

Attachment of pourspout 32 to holding tank 24 is accomplished by disposing the spout in general alignment with opening 34 and circumferentially orienting the spout such that bayonets 52 register with spaces 76. The spout is then axially advanced into opening 34. This serves to dispose O-ring seal 46 within wall 68 such that the O-ring forms a seal between the O.D. of the pourspout and the I.D. of the outlet wall. The pourspout is positioned to a point where the sides of each of the bayonets are disposed axially inwardly of the leading edges of the partial screw threads 70. Now rotation of the pourspout about axis 48 is effective to dispose one edge of each bayonet behind the corresponding leading edge of the corresponding partial screw thread 70. The relative dimensions of the partial screw threads 70 and portions 60 are such that a threading action takes place as the pourspout is rotated so as to urge the pourspout inwardly. The extent to which the two can be threaded may be limited by abutment of flange 42 with the end edge 78 of wall 68, but there will be a sufficient amount of thread engagement to assure the desired attachment. The connection therefore serves to interlock the spout on the holding tank with the O-ring providing an effective seal between the two so as to prevent the leakage of material through the point of attachment.

Figure 7:
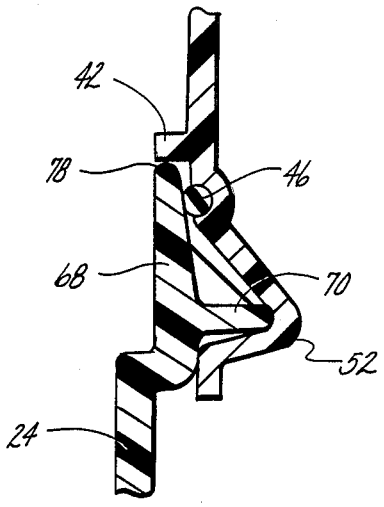
FIG. 7 is a fragmentary cross sectional view on an enlarged scale taken substantially in the direction of arrows 7—7 in FIG. 2.

FIG. 7 illustrates the interaction between one partial thread 70 and the corresponding bayonet 52, and the sealing of O-ring 46 between wall 68 and the pourspout when the pourspout is attached to the holding tank.

It will be further observed that the construction of the bayonets 52 constitutes an efficient organization and use of material. The nominal thickness of material throughout the extent of the bayonets is substantially uniform, a desirable attribute for manufacturing purposes, yet the bayonets are endowed with sufficient strength for their threaded attachment to the holding tank. In this regard it will be observed that flange 62 performs a rigidifying function for the portion 60 which interacts with the partial screw thread 70 when the pourspout is attached to the holding tank. It will be also noticed that the limited arcuate and radial extents of bayonets 52 imposes a minimal restriction on the cross sectional area of the opening through the pourspout at the inlet end because the remainder of the inlet end has a nominal diameter indicated by the reference numeral 80 in FIG. 4. Accordingly, the arrangement and organization of the bayonets constitutes an efficient use of material in fabrication of the pourspout and effective performance for use.

Figure 8:
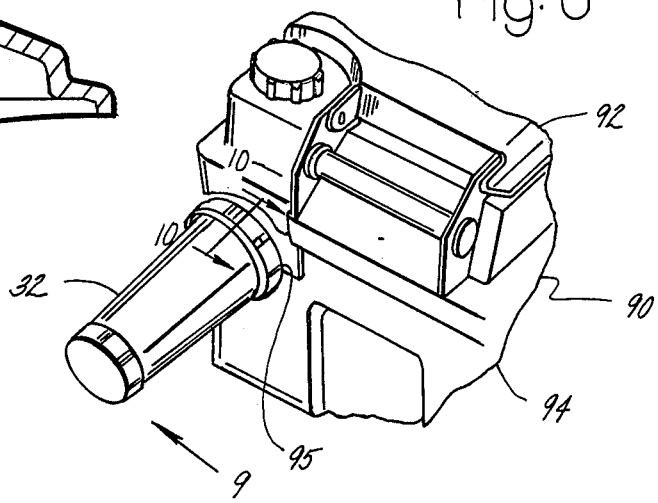
FIG. 8 is a fragmentary perspective view illustrating the pourspout of the present invention in use on another model of portable toilet different from the model of FIG. 1.

FIG. 8 illustrates pourspout 32 in use with a different model of portable toilet 90. Portable toilet 90 like portable toilet 20, comprises a seat section 92 and a holding tank section 94. Instead of the outlet opening 95 of holding tank section 94 being covered by the seat tank section 92 when the toilet is in use, outlet opening 95 is located on the exterior at one upper corner of the rear sidewall. Whereas the cap which was used with toilet 20 prior to the pourspout of the present invention has an internal thread which engaged the partial threads 70 when the cap was installed on the outlet opening 34, outlet opening 95 of holding tank 94 comprises an external thread.

Figure 10:
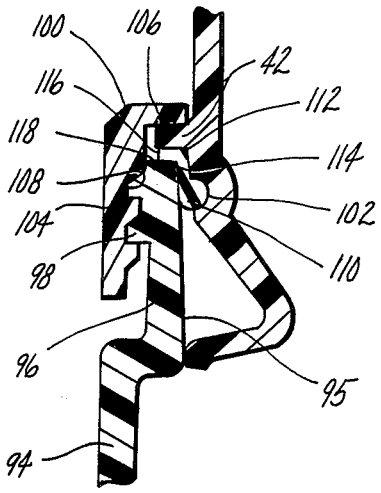
FIG. 10 is a fragmentary cross sectional view on an enlarged scale taken substantially in the direction of arrows 10—10 in FIG. 8.

FIG. 10 illustrates a fragmentary sectional view through the attachment of the pourspout to holding tank 94. The holding tank outlet opening 95 comprises a circular tubular wall 96 having an external thread 98. The I.D. of wall 96 is essentially smooth. Bayonets 52 do not provide for attachment to this embodiment of portable toilet. Although they fit within wall 96, they present a minimum obstruction which has no substantial effect on the pourout flow.

The attachment as shown in FIG. 10 comprises the use of a retainer 100 and a seal 102 which is of a different configuration from the attachment reflected by FIG. 7. Retainer 100 is a circular annular element comprising a sidewall 104 with a radially inwardly directed flange 106 at one end. The sidewall 104 contains an internal screw thread 108. As will be apparent from consideration of FIGS. 8 and 10, retainer 100 is fitted over the narrower outlet end of pourspout 32 and brought onto inlet end 36 so that flange 106 overlappingly confronts flange 42. Screw thread 108 is engaged with screw thread 98 by rotating the retainer about axis 48 after the inlet end of the pourspout has been disposed within outlet wall 96. The action of flange 106 on flange 42 serves to draw the pourspout inwardly toward the holding tank.

Seal 102 is a one-piece annular elastomeric element comprising a generally O-shaped portion 110 with which a flange portion 112 integrally joins. The O-shaped portion 110 seats in groove 44. Flange portion 112 comprises an axial section 114 extending from O-shaped portion 110 and a radial section 116 extending from axial section 114. It will be observed that seal 102 affords the possibility for sealing either by means of the fit of the portions 110, 114 within the I.D. of wall 96 and/or by portion 116 providing a compression seal between flange 42 and the end edge 118 of outlet wall 96. This construction is advantageous for certain models of toilets where a greater tolerance has been allowed on dimensions. For example, this is generally true in the case of holding tanks which are blow molded, rather than injection molded. With blow molding procedures, it is more difficult to accurately control the dimensions than with injection molding procedures. Therefore, the axial compression of radial portion 116 can particularly compensate for variations in tolerance through the compressibility of the elastomeric seal as the retainer is tightened onto the holding tank.

Figure 9:
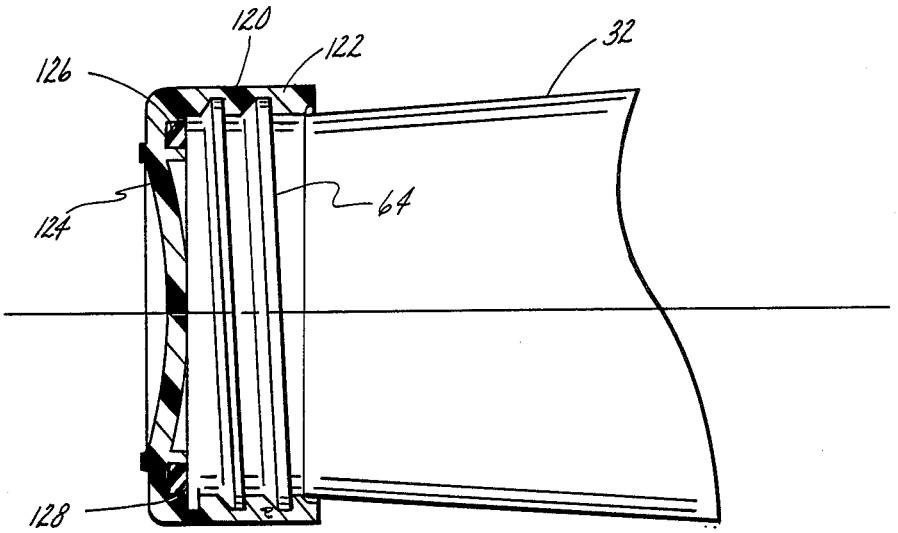
FIG. 9 is a fragmentary view on an enlarged scale and partly in cross section taken substantially in the direction of arrow 9 in FIG. 8.

FIG. 9 illustrates a closure cap 120 threaded onto the outlet end of pourspout 32. The closure cap comprises an internally threaded sidewall 122 which threads onto threads 64 and an endwall 124 which is of generally circular shape. A groove is provided within cap 120 extending around end wall 124 and a resilient seal 126 is disposed within this groove as a part of the cap to provide a seal against the end edge 128 of the pourspout when the cap is fully tightened onto the outlet end. FIG. 8 illustrates cap 120 in place on the pourspout while FIG. 2 illustrates the pourspout with the closure cap having been removed.

Figure 11:
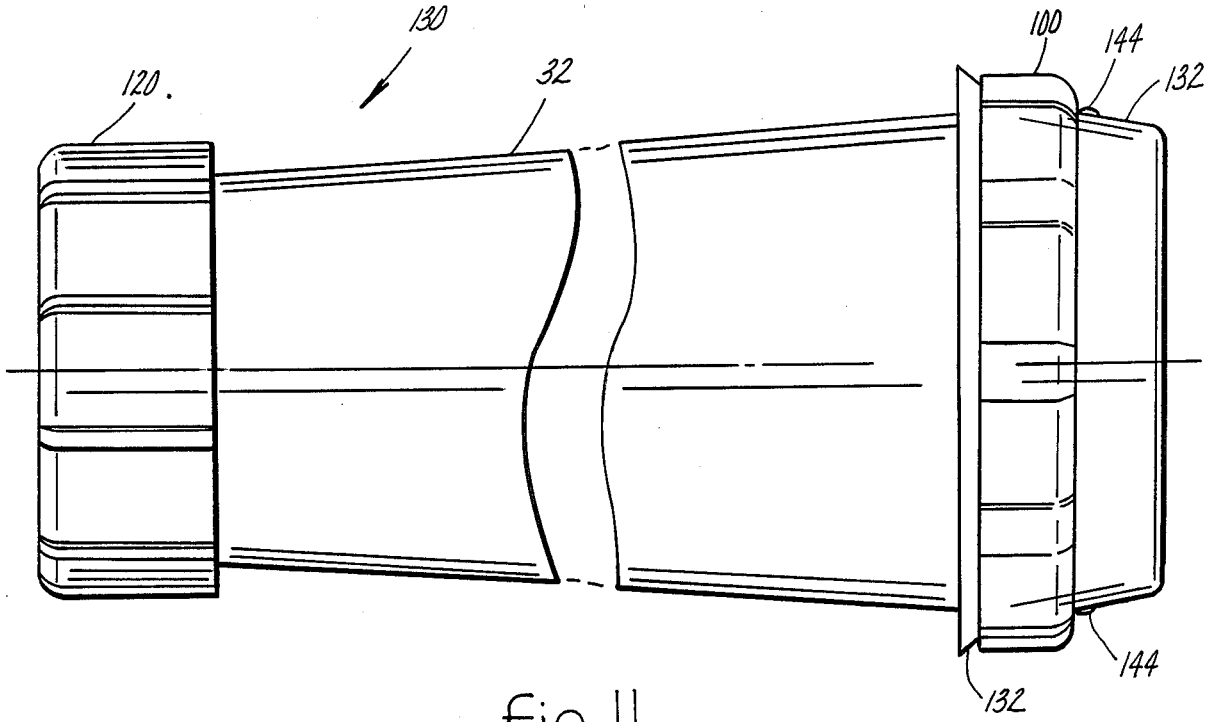
FIG. 11 is a longitudinal view having a portion broken away of the pourspout kit of the present invention for accommodating both models of portable toilets shown in FIGS. 2 and 8.

The present invention also contemplates a particular commercial configuration in which the pourspout is offered for sale to users. This configuration is in the form of a pourspout kit designated by the general reference numeral 130 in FIG. 11.

Kit 130 comprises the following components which have been previously described: pourspout 32, closure cap 120, and retainer 100. In addition the kit comes with a pourspout inlet closure cap 132 which fits over the end of the pourspout inlet section.

The kit also comes with each type of O-ring seal 46, 102. This affords the user the full set of components needed to use the pourspout with either type of holding tank outlet opening described above. It would be possible to provide only a single O-ring seal 102 which could be trimmed if necessary to remove excess material and make it the same as the O-ring 46, but this would then impose upon the user the need to use a cutting tool to remove the excess material.

Figure 12:
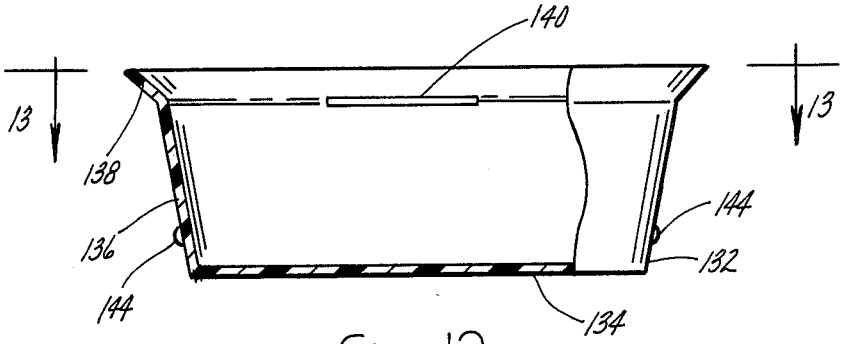
FIG. 12 is a longitudinal view having a portion broken away of one of the elements of FIG. 11 shown by itself.
Figure 13:
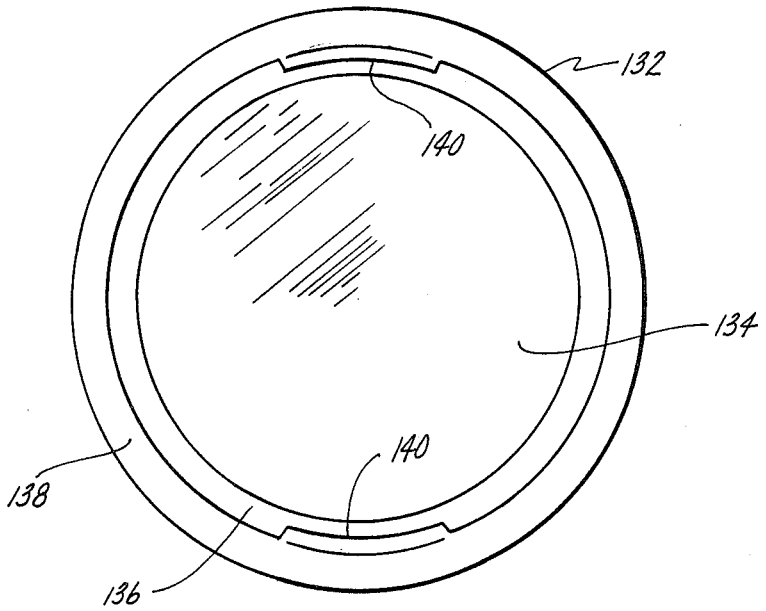
FIG. 13 is a full axial end view of FIG. 12 as taken in the direction of arrows 13—13.

Inlet closure cap 132 is shown by itself in FIGS. 12 and 13, and referring to these latter two figures, the reader will see that it is a generally cup-shaped element having an end wall 134 from which extends an outwardly flaring frusto-conically tapered sidewall 136. Sidewall 136 terminates in an outwardly flared lip 138 having a taper which is even greater than the taper of sidewall 136.

On diametrically opposite sides of the I.D. of closure cap 132, and at the junction of sidewall 136 and lip 138, the closure cap is provided with a pair of inwardly projecting ridges 140. As can be seen from consideration of FIGS. 12 and 13 the two ridges have a limited arcuate extent about the longitudinal axis of the closure cap. It is these ridges 140 which provide for the removable attachment of cap 132 with the inlet end section of the pourspout.

Referring back to FIG. 4, one will observe that flange 42 is not circumferentially continuous. The flange is embodied as two separate flange segments of uniform arcuate extent, which are separated by equal slots 142 on diametrically opposite sides.

Closure cap 132 is dimensioned such that when placed in alignment with the inlet end section of the pourspout and circumferentially oriented such that ridges 140 register with slots 142, the closure cap may be moved onto the end of the pourspout to dispose ridges 140 axially beyond the flange segments. A rotation of the closure cap relative to the pourspout will be effective to dispose the ridges 140 directly behind the flange segments so that the closure cap is thereby secured onto the end of the pourspout.

Cap 132 also contains integral retaining buttons 144 formed in the outside surface of its sidewall for storing retainer 100. The retainer snaps onto and off of cap 132, with the retainer flange snapping over buttons 144. Thus, the kit has no loose pieces, the O-ring or rings having been placed onto the spout.

The kit may be put to use in the following manner. The existing portable toilet will typically have its own closure cap for its outlet opening. That cap is first removed. Inlet closure cap 132 is removed from the kit, and depending upon the nature of the holding tank outlet opening (i.e. either internal or external thread), the inlet end of the pourspout is provided with one of the O-ring seals and attached to the holding tank outlet.

Where the holding tank outlet has an internal thread and the kit is not expected to be used with a portable toilet having an external thread on its holding tank outlet, retainer 100 may be unsnapped from cap 132 and discarded.

When the contents of the holding tank are to be discharged through the attached pourspout, the outlet closure cap 120 is unthreaded from the pourspout. The holding tank is tipped with the spout pointing toward the disposal facility so that the contents of the holding tank are thereby deposited into the disposal facility.

It is possible, and desirable, to conduct one or more rinsing operations on the holding tank. This can be done by introducing rinse water through the pourspout, reattaching the outlet closure cap 120, shaking the holding tank to slosh the rinsewater around the tank's interior, removing the closure cap and then pouring the rinse water out of the holding tank into the disposal facility.

The dumping procedure may be concluded in the following manner. The pourspout may be removed from the holding tank, grasped around the outside of its main wall, and held under a stream of rinse water to rinse away any residual materials or residue which may have been left on it from the dumping procedure. The inlet and outlet closure caps are then both re-attached to the pourspout. Although this rinse procedure does not constitute sanitizing, the provision of the inlet and outlet closures for the pourspout permits it to be stowed without concern for rinse and/or residue leaking onto the location at which the spout is stowed. It also permits the spout to be handled and stowed with less concern than would be required were closures not provided for both ends. Accordingly, the pourspout stowage capability constitutes a further attribute of the invention.

The preferred material for the several parts of the kit, with the exception of the O-ring seals, comprises any suitable plastic. Preferably the plastic parts are fabricated by conventional plastic molding procedures. The invention thereby provides an accessory which can be purchased by itself, or in combination with a new toilet, to enhance the utility of the portable toilet, particularly insofar as disposal procedures are concerned.

While a preferred embodiment of the invention has been disclosed, it will be appreciated that principles are applicable to other embodiments.

What is claimed is:

1. A pourspout accessory kit for use with a portable toilet having a holding tank to facilitate dumping of the contents of the holding tank via an outlet opening in the holding tank, said accessory kit comprising a pourspout having an inlet end for attachment to the outlet opening of a holding tank, an outlet end spaced from said inlet end, an inlet end closure cap for removably closing said inlet end, an outlet end closure cap for removably closing said outlet end, integral flange means extending circumferentially around the pourspout adjacent its inlet end, sealing means for extending circumferentially around the pourspout to a side of said flange means toward the inlet end of the pourspout, integral bayonets projecting from the inlet end of the pourspout for attachment to a holding tank internally of the holding tank's outlet opening, said bayonets being enclosed by said inlet end closure cap with the latter disposed closing said inlet end, said inlet end closure cap removably attaching to the inlet end of said pourspout via said flange means and also enclosing said sealing means with the latter disposed circumferentially around the pourspout to the side of said flange means toward the inlet end of the pourspout, and a separate annular retainer for passing onto the pourspout via said outlet end along the length of the pourspout to said inlet end, said retainer having a cooperative engagement with said flange means providing for attachment to the holding tank externally of the holding tank's outlet opening when said inlet end closure cap is removed from the pourspout inlet end.

2. An accessory kit as set forth in claim 1 in which said flange means is circumferentially interrupted so as to provide two circumferentially extending flange segments which are spaced apart by circumferential gaps on diametrically opposite sides of the pourspout about the pourspout longitudinal axis and in which said inlet end closure cap has ridges on diametrically opposite sides whose circumferential extents are less than the circumferential extents of said gaps so as to permit said inlet end closure cap to be removably attached to said pourspout by passing said ridges axially onto said inlet end closure cap to dispose said ridges axially behind said flange segments and upon rotation of said inlet end closure cap relative to said pourspout, said ridges are lodged behind said flange segments to thereby removably secure said inlet end closure cap on said inlet end of said pourspout.

3. An accessory kit as set forth in claim 2 incuding a circumferentially continuous groove extending around the outside of the pourspout to the side of said flange means which is toward side inlet end and said sealing means comprising an O-ring seal disposed in said groove, said O-ring seal having a portion of circular cross section seated in said groove and with the radial dimension from the longitudinal axis of the pourspout to the radially outermost point of said O-ring seal portion of circular cross section being less than the radial dimension from the longitudinal axis of the pourspout to the radially outermost point of said flange.

4. An accessory kit as set forth in claim 3 in which said O-ring seal comprises only said portion of circular cross section.

5. An accessory kit as set forth in claim 3 in which said O-ring seal has in addition to said circular portion, an integral flange portion extending from said circular portion toward said pourspout flange means.

6. An accessory kit as set forth in claim 5 in which said flange portion of said O-ring seal has an axial segment extending from said circular portion thereof and a radial segment extending from said axial segment, said radial segment being disposed against the side of said pourspout flange means which is toward said inlet end of the pourspout.

7. An accessory kit as set forth in claim 1 in which said bayonets comprise two bayonets on diametrically opposite sides of the pourspout having limited arcuate extents about the longitudinal axis of the pourspout, each bayonet having a first portion extending both radially inwardly and axially away from said pourspout flange, a second portion extending radially outwardly from said first bayonet portion and having an edge, and a third portion disposed on said second portion, said third portion comprising a wall extending axially away from said second bayonet portion on the side thereof opposite said pourspout flange, said wall bounding portions of the edge of said second bayonet portion, all said portions of said bayonets being a generally uniform thickness.

8. An accessory kit as set forth in claim 1 in which said retainer has an endwall overlapping said flange means and a sidewall extending from said endwall radially outwardly of said flange means, said sidewall having means on its interior providing for attachment to a holding tank outlet externally of the holding tank's outlet opening.

9. An accessory kit as set forth in claim 8 in which said means on said sidewall providing for attachment to a holding tank outlet externally of the holding tank's outlet opening comprises an internal screw thread within the sidewall of said retainer.

10. An accessory kit as set forth in claim 1 in which said inlet end closure cap comprises an endwall and a sidewall extending from said endwall toward the outlet end of the pourspout with the inlet end closure cap disposed closing said inlet end, said sidewall of said inlet end closure cap having a frusto-conically tapered shape extending from its endwall and an outwardly flared lip projecting from said frusto-conically shaped sidewall at a greater frusto-conically shaped taper than that of said sidewall, said inlet end closure cap including ridges within its interior at the juncture of its lip and sidewall, said pourspout flange means extending around the outside of the pourspout adjacent the inlet end thereof, and said ridges providing for the removable engagement of said inlet end closure cap with said flange means.

11. In a pourspout accessory kit for use with a portable holding tank of a toilet the combination of a pourspout having inlet and outlet ends, an inlet end closure cap for removably closing said inlet end, said pourspout comprising integral flange means extending circumferentially around the pourspout adjacent its inlet end, sealing means for extending circumferentially around the pourspout to a side of said flange means toward the inlet end of the pourspout, integral bayonets projecting from the inlet end of the pourspout for attachment to a holding tank internally of the holding tank's outlet opening, said bayonets being enclosed by said inlet end closure cap with the latter disposed closing said inlet end, said inlet end closure cap removably attaching to the inlet end of said pourspout via said flange means and also enclosing said sealing means with the latter disposed circumferentially around the pourspout to the side of said flange means toward the inlet end of the pourspout, and a separate annular retainer for passing onto the pourspout via said outlet and along the length of the pourspout to said inlet end, said retainer having a cooperative engagement with said flange means providing for attachment to a holding tank externally of the holding tank's outlet opening when said inlet end closure cap is removed from the pourspout inlet end.

12. In an accessory kit for use with a portable toilet holding tank to facilitate the dumping of the contents of the holding tank through an outlet opening in the holding tank, a pourspout comprising an inlet end and an outlet end spaced from said inlet end, said pourspout having flange means extending circumferentially around the pourspout adjacent its inlet end, sealing means for extending circumferentially around the pourspout to a side of said flange means toward the inlet end of the pourspout, integral bayonets projecting from the inlet end of the pourspout providing for attachment of the pourspout to a holding tank internally of the holding tank's outlet opening, said bayonets having limited arcuate extents about the longitudinal axis of the pourspout, each bayonet having a first portion extending both radially inwardly and axially away from said flange means, a second portion extending radially outwardly from said first bayonet portion and having an edge, and a third portion disposed on said second portion, said third portion comprising a wall extending axially away from said second bayonet portion on the side thereof opposite said flange means, said wall bounding portions of the edge of said second bayonet portion, all said portions of said bayonets being of generally uniform thickness.

* * * * *